United States Patent [19]

Paz

[11] Patent Number: 4,509,215

[45] Date of Patent: Apr. 9, 1985

[54] DISPOSABLE LINER FOR A MUSICAL POTTY CHAIR

[76] Inventor: Lirida Paz, 815 Summer St., Elizabeth, N.J. 07202

[21] Appl. No.: 508,565

[22] Filed: Jun. 28, 1983

[51] Int. Cl.[3] ..... A47K 11/02; G08B 21/00

[52] U.S. Cl. ..... 4/452; 4/479; 4/483; 4/144.2; 4/661

[58] Field of Search ..... 4/483, 479, 661, 452, 4/451, 144.2, 144.3, 453, 454, 457; 493/217; 229/3.1

[56] References Cited

U.S. PATENT DOCUMENTS

| | | | |
|---|---|---|---|
| 1,286,516 | 12/1918 | Bowron | 4/479 |
| 2,699,139 | 1/1955 | Mackey | 116/67 R X |
| 2,721,531 | 10/1955 | Findley, Jr. | 116/67 R |
| 2,788,764 | 4/1957 | Headlee | 116/67 R |
| 3,020,528 | 2/1968 | Swanson, Jr. et al. | 4/449 |
| 3,061,840 | 11/1962 | Presseisen | 4/451 |
| 3,268,916 | 8/1966 | Hix, Jr. | 4/483 |
| 3,364,478 | 1/1968 | Waard | 4/483 |
| 3,377,631 | 4/1968 | Whitney | 4/452 |
| 3,416,163 | 12/1968 | Jordan | 4/483 |
| 3,475,767 | 11/1969 | Friesen et al. | 4/452 |
| 3,495,278 | 2/1970 | Peters | 4/144.2 X |
| 3,546,716 | 12/1970 | Laumann | 4/452 |
| 3,591,870 | 7/1971 | Friesen | 4/144.2 |
| 3,602,924 | 9/1971 | Kneisley | 4/452 X |
| 3,680,151 | 8/1972 | Boardman et al. | 4/483 X |
| 3,713,178 | 1/1973 | Mallette | 4/451 |
| 3,737,920 | 6/1973 | Savee | 4/452 X |
| 4,162,490 | 7/1979 | Fu et al. | 4/483 |
| 4,174,544 | 11/1979 | Furusawa | 4/457 X |

FOREIGN PATENT DOCUMENTS

| | | | |
|---|---|---|---|
| 18469 | 9/1969 | Australia | 4/483 |
| 2359936 | 6/1974 | Fed. Rep. of Germany | 4/483 |
| 1028696 | 5/1953 | France | 116/67 R |

*Primary Examiner*—Henry K. Artis

*Attorney, Agent, or Firm*—James M. Trygg

[57] ABSTRACT

A disposable liner for a musical potty chair is disclosed having a light weight receptacle for holding the liner in position and a novel mechanism for effecting operation of a music box upon elimination into the receptacle by a child using the device.

4 Claims, 5 Drawing Figures

2
12
14
10
100
20
38
36
36
36
72
16
70
30
16

124
106
110
100
112
124
132
134
B
116
110
110
124
110
A
106
114
114
A
106
104
130
104
144
142
144
140
102

32
30
38
36
40
36
52
62
54
36
50
56
60
46
34
42
44
55
64
74
72
70

32
100
30
144
104
140
52
102
60
50
36
36
46
34
36
70
72

110
150
150
150
124
120
126
126

DISPOSABLE LINER FOR A MUSICAL POTTY CHAIR

BACKGROUND OF THE INVENTION

This invention relates to a disposable liner for a childrens' potty chair and more particulary to such devices for a potty chair having a mechanism for sounding musical tones upon use by the child.

Disposable flexible plastic containers that appear in the art for receiving excrement are generally of two types. An example of the first type is described in U.S. Pat. No. 3,602,924 issued Sept. 7, 1971 to Kneisley. Kneisley discloses an apparatus suitable for use as either a storage unit or a commode having a sacklike container resting on a support member. The open end of the sack is attached to a flange which maintains the upper end of the sack in a wide open position. Additionally, the flange may be rotated, thereby rotating the upper portion of the sack and causing the sides of the sack to converge and twist together thereby effectively sealing the contents of the lower portion of the sack from the ambient air. An example of the second type of container that appears in the art is described in U.S. Pat. No. 3,475,767 issued Nov. 4, 1969 to Friesen which discloses a disposable container for receiving excrement. This device takes the general shape of a bottle and has a drawstring arranged around its opening for closing the opening after use. The device is designed to receive the excrement from a bed pan or other similar container rather than directly from the donor.

In addition to the two types of disposable containers described above, there are various musical potty chairs in the prior art, most of which utilize a commercially available music box mechanisn for producing the desired musical tones. Some devices are battery operated, see for example, U. S. Pat. No. 3,691,980, issued Sept. 19, 1972 to Shastal, while others are spring actuated, as is the music box of the present invention. All of these devices, however, provide a spring based pivoting support for the potty. The support is usually arranged so that when the child eliminates, the additional weight of the excrement in the potty causes the support to undergo pivotal movement in opposition to the spring. This pivotal movement then causes a member to disengage the escapement mechanism of a music box to enable it to operate. The moving parts of these devices, especially the potty, comprise a substantial mass, the inertia of which must be overcome, including static friction of the mechanism, solely by the small weight of the child's excrement. The mechanism, therefore, must be finely balanced and have low fricton bearings at all pivot points. To this inventor's knowledge no attempt as ever been made to reduce the mass of the device by providing a potty of open basket like structure having a diposable liner inserted therein.

SUMMARY OF THE INVENTION

According to the present invention, there is provided a potty chair having a seat and a receptacle removably attached thereto for receiving excrement. The receptacle includes a bottom, an outwardly turned flange, and at least one support member, one end of which is rigidly attached to the flange and the other end of which is attached to the bottom thereby forming a rigid basket like structure. The potty chair includes a liner means for forming a liquid containing membrane within and supported by the receptacle. The liner means is constructed of water impermeable material and has a bottom, a side wall, and a open top having a drawstring means arranged thereabout for selectively deforming the open top into either of two positions. In the first position the open top is arranged so that a portion of the side wall of the liner is turned outwardly over and under the flange and the drawstring pulled snuggly to secure the top of the liner about the flange. In the second position the open top is arranged so that the drawstring is pulled snuggly to close the open top for disposal of the liner.

DESCRIPTION OF THE PREFERRED EMBODIMENT

The child's potty chair described herein is more fully described in the copending application of Lirida Paz, Ser. No. 508,573 filed concurrently with the present application.

Figure 1:
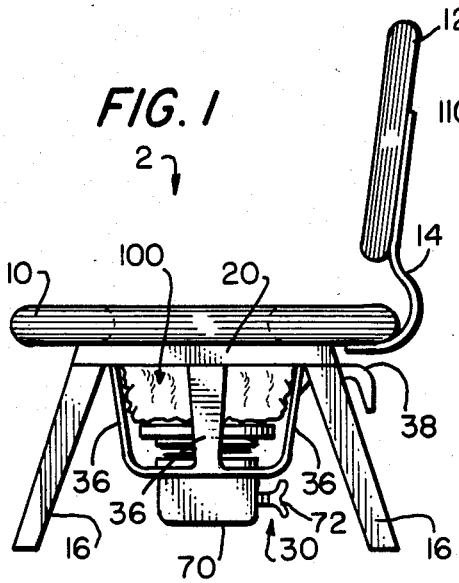
FIG. 1 is a side view of a child's potty chair embodying the teachings of the present invention.

There is shown in FIG. 1 a child's potty chair 2 having a seat 10, a back rest 12, a pair of supporting brackets 14 for supporting and positioning the back rest with respect to the seat, and four legs 16 for supporting the chair. The brackets 14 and legs 16 are attached in the usual manner by suitable screw fasteners, not shown, or other similar fasteners. A pair of guide rails 20 are attached with suitable screw fasteners to the underside of the seat 10, as shown in FIG. 1. Each rail 20 has an undercut 22 formed longitudially in its top surface and facing inwardly toward the center of the chair, the two undercuts being substantially parallel for their entire lengths are arranged for receiving the upper lange of a removable potty.

Figure 2:
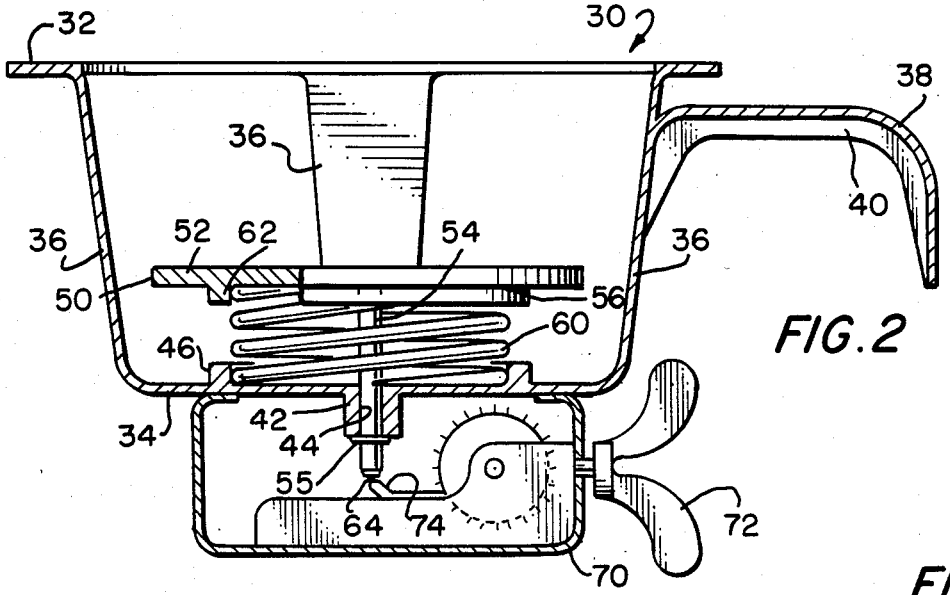
FIG. 2 is a partial sectional view of the potty shown in FIG. 1 without the disposable liner.

A potty or receptacle 30 is shown in FIG. 2 and includes a circular rim or flange 32, a bottom 34, and three or four vertically disposed ribs 36 connecting the flange 32 to the bottom 34, forming a rigid basket like structure. An outwardly projecting handle 38 is formed integral to one of the ribs 36 just below the flange 32, and is strengthened by an integrally formed rib 40. The bottom 34 includes a boss 42 formed therein having a central hole 44 arranged substantially perpendicular to the upper surface 33 of the flange 32. An annular wall 46 formed in the bottom 34 of the receptacle 30 and projecting vertically upwardly is arranged substantially concentric to the hole 44.

A disc or platform 50 having a top surface 52 which may be either flat or concave upward is disposed within the basket like structure of the receptacle 30 as shown in FIG. 2. A cylindrically shaped pin 54, rigidly attached to the center of the disc 50, projects downwardly through the hole 44. The pin 54 and the hole 44 are sized to permit unrestrained vertical movement of the pin within the hole without an appreciable amount of side movement of the pin. Suitable materials should be chosen for the pin 54 and the base 42 which will permit this movement without galling or sticking in any way.

Most thermosetting plastics having a hard, slick, outer surface will work well.

A retaining ring 55 is attached to the pin 54 in the usual manner for limiting upward movement of the pin 54 and the disc 50 thereby rendering the disc and pin captive to the receptacle 30. This will prevent disengagement of the parts should the receptacle 30 be inverted for any reason. An annular wall 56 formed in the lower surface of the disc 50 and projecting downwardly is arranged vertically above and in alignment with the wall 46.

A helical compression spring 60 is disposed between the bottom 34 of the receptacle 30 and the disc 50 and is arranged to apply light upward pressure on the disc sufficient to support its weight and that of the pin 54 thereby maintaining the disc 50 at a point of equalibrium. The disc is free to move in either an upward or downward direction upon the application of a suitable additional force. The two ends of the spring 60 loosely engage the inner surfaces 62 of the annular walls 46 and 56 to limit transverse movement of the spring. It should be understood that the spring 60 is constructed so that it will support the weight of the disc 50, the pin 54, and the weight of a disposable liner, to be described below, yet should an additional relatively small weight be included, the spring 60 would compress a substantial amount in response thereto.

A commercially available music box 70 is attached to the underside of the bottom 34 as shown in FIG. 2. Suitable screw fasteners or rivets may be used for this purpose. The music box 70 is of the spring drive type having an external key 72 for manually winding the spring motor. A lever 74 has one end that operationally engages the escapement mechanism, not shown, of the music box and another end that is adjacent and lightly touching the end 64 of the pin 54. The lever 74 is arranged so that it blocks operation of the spring motor of the music box so long as the end only lightly touches the end 64 of the pin 54, as shown in FIG. 2. If the end 64 of the pin 54 is made to depress the lever 74 a specific amount, the lever will disengage the escapement mechanism permitting the spring motor to operate thereby operating the music box.

Figure 3:
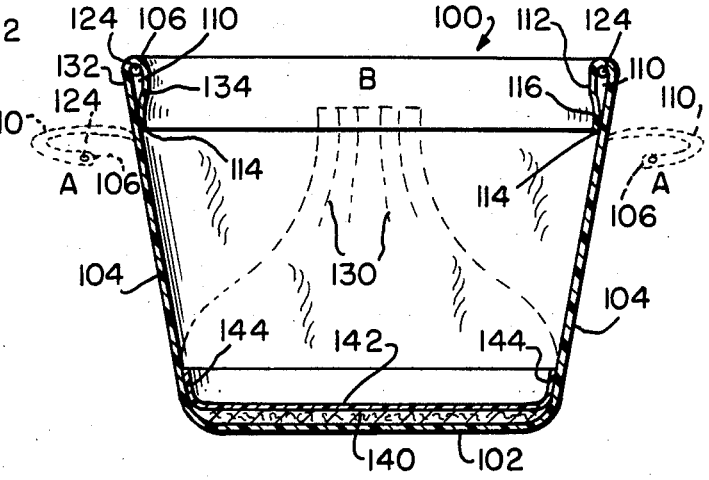
FIG. 3 is a side elevation sectional view of a disposable liner for use in the potty shown in FIG. 1.
Figure 4:
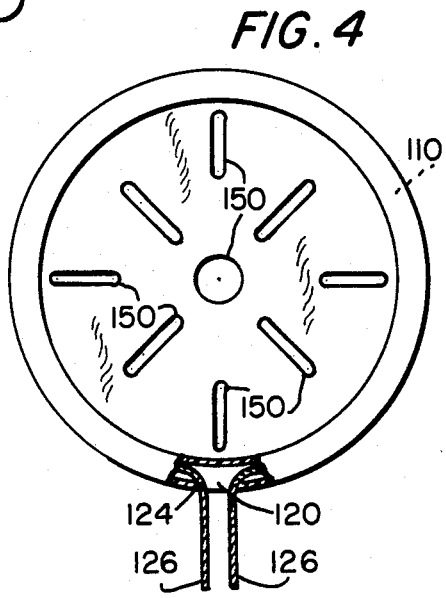
FIG. 4 is a plan view of the disposable liner shown in FIG. 3.

In FIGS. 3 and 4, there is shown a potty liner 100 constructed of a thin plastic material, or the like, having substantial resiliency and being impermeable to liquids. The liner 100 includes a bottom 102, a side wall 104, and an open top 106. While it is preferable that the bottom be somewhat circular, as shown in FIG. 4, other suitable shapes that may be more economical to manufacture may be used.

Figure 5:
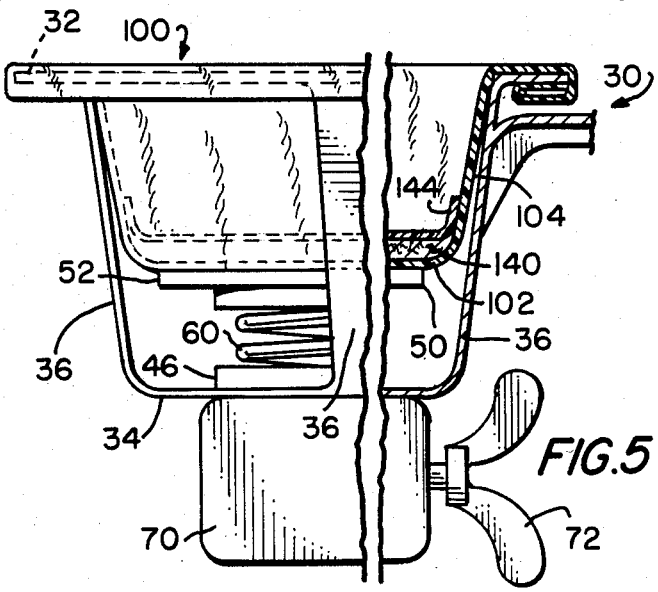
FIG. 5 is a view similar to that of FIG. 2 but showing the disposable liner arranged within the potty.

An enclosed continuous channel 110 completely encircles the open top 106 of the liner 100 and is formed by folding the upper portion 112 of the side wall 104 over on itself and attaching the edge 114 to the side wall 104 at 116. This attachment may be effected by suitable bonding techniques or other suitable attachment means. An opening 120 in the sidewall 104 communicates with the interior of the channel 110 as shown in FIG. 4. A drawstring 124 having ends 126 projecting out of the opening 120, as shown in FIG. 4, is disposed within the channel 110 encircling the open top 106 of the liner 100. The drawstring 124 permits the liner 100 to assume either one of two positions as indicated by dashed lines at A and B as shown in FIG. 3. As indicated by the position shown at A, the open top 106 is stretched outwardly over and then under the flange 32 of the receptacle 30 as shown in FIG. 5. The drawstring is then snugly secured to hold the disposable liner in position as shown in FIG. 5. As indicated by the position shown at B, the open top 106 is gathered into folds 130 and the drawstring snuggly secured to effectively close the opening 106 thereby sealing it from the ambient air. It should be noted that the preferred structure of the channel 110 is that it be continuous so that an effective seal will occur when the top 106 of the liner 100 is secured in the indicated position shown at B, by the drawstring 120. However, another arrangement wherein the outer wall 132 of the channel 110 comprises bands or loops will be acceptable as long as the inner wall 134 is continuous and a suitable seal is effected when the top 106 is secured in the position indicated by B in FIG. 3.

The liner 100 includes a layer of liquid absorbing material disposed inside and adjacent to the bottom 102. The layer 140 is held in place by a thin layer 142 of plastic material overlapping the layer 140 and having its peripheral edge 144 attached to the inside surface of the side wall 104 by suitable bonding or other suitable attachment means. A series of spaced apart elongated or circular perforations 150 are arranged in the layer 142 so that liquids may pass therethrough and be absorbed by the layer 140 of liquid absorbing material. The liner 100 is constructed of a very thin, light weight plastic sheet material and, as such, will exert an almost insignificant amount of downward pressure on the disc 50. However, the spring 60 should be chosen so that it will support the small additional weight of the liner 100 as well as that of the disc 50 and the pin 54.

In operation, a fresh liner is placed in the receptacle 30 as shown in FIG. 4, the spring motor of the music box 70 fully wound, and the receptacle 30 assembled into position under the potty chair as shown in FIG. 1. As the child using the potty chair eliminates into the lined receptacle, the weight of the excrement is added to the combined weights of the bottom 102 of the liner 100, disc 50, and pin 54 being opposed by the spring 60. As this added weight of the excrement becomes sufficient to overcome the inertia and static fricton of the disc, pin, and spring structures, the disc 50 will begin to move downwardly under the urging of the excrement, as viewed in FIG. 5, against the opposing force of the spring 60. The flexibility of the side wall 104 of the liner 100 permits the bottom 102 to move downwardly with the disc 50 while the open top 106 is secured to the flange 32, as shown in FIG. 3. The end 64 of the pin 54, will move downwardly concurrently with the downward movement of the disc 50, thereby depressing the lever 74. This causes the end of the lever 74 to disengage the escapement mechanism thereby causing the music box to operate.

It is pointed out that an advantage of the structure of the present invention is that the mass of the potty is greatly reduced and therefore the total mass of the moving parts required to actuate the music box in response to the weight of the child's excrement is minimized. This in turn minimizes the combined friction and inertial forces that must be overcome by the small additional weight of the excrement thereby providing a more sensitive and reliable musical potty chair.

Accordingly, there has been disclosed a disposable liner for a musical potty chair having a light weight receptacle for holding the liner in position. It is understood that the above described embodiment is merely illustrative of the application of the principles of this invention. Upon reviewing the present disclosure numerous other embodiments may be devised by those skilled in the art without departing from the spirit and scope of this invention, as defined by the appended claims.

I claim:

1. In a potty chair having a seat and a receptacle removably attached thereto for receiving excrement including feces and urine, wherein said receptacle includes a bottom, an open top having an outwardly turned flange, and at least one support member, one end of which is rigidly attached to said flange and the other end of which is rigidly attached to said bottom, thereby forming a rigid basket like structure, said potty chair including a liner means for forming a liquid containing membrane within and supported by said receptacle, said liner means being constructed of thin, light-weight water impermeable material of low mass and having a bottom, a flexible side wall, and an open top having a drawstring means arranged thereabout for selectively deforming said open top into either of two positions, wherein the first position, said open top is arranged so that a portion of said side wall of said liner is turned outwardly over and under said flange and said drawstring means pulled snuggly to secure said portion of said side wall about said flange, and wherein the second position, said open top is arranged so that said draw string means is pulled snuggly to close said open top for disposal of said liner wherein said potty chair includes a music box means for sounding musical tones, a platform means having an upper surface arranged to undergo linear movement in an upward direction and a downward direction for actuating said music box means wherein said upper surface of said platform means is in contact with and supports the weight of said bottom of said liner means said flexible side wall being arranged so that said bottom of said liner means will move in correspondence to and along with said upper surface of said platform means while said receptacle remains stationary.

2. The apparatus set forth in claim 1 wherein said liner means includes an absorbent means in association with said bottom of said liner means for absorbing urine and liquids associated with feces.

3. The apparatus set forth in claim 1 wherein said drawstring means includes a plurality of loops spaces apart around the outer periphery of said open top and a flexible cord or string member having two ends and arranged within said loops and completely encircling said outer periphery of said open top.

4. The apparatus set forth in claim 2 wherein said drawstring means includes an annular enclosed channel formed around said open top of said liner means and having an opening facing outwardly therefrom, and a flexible cord or string member having two ends and arranged within said enclosed channel substantially encircling said outer periphery of said open top, wherein said two ends of said flexible cord or string member project outwardly from said opening in said channel.

* * * * *